US008494401B2

(12) United States Patent
Doody et al.

(10) Patent No.: US 8,494,401 B2
(45) Date of Patent: Jul. 23, 2013

(54) ACTIVE OZONE SCRUBBER

(75) Inventors: Michael A Doody, Manchester, NY (US); Gerald F Daloia, Webster, NY (US); Heiko Rommelmann, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/226,701

(22) Filed: Sep. 7, 2011

(65) Prior Publication Data

US 2013/0058677 A1 Mar. 7, 2013

(51) Int. Cl.
*G03G 21/20* (2006.01)
*G03G 21/00* (2006.01)

(52) U.S. Cl.
USPC ..... 399/93; 399/98

(58) Field of Classification Search
USPC ..... 399/91, 93, 98
See application file for complete search history.

(56) References Cited

U.S. PATENT DOCUMENTS

| | | | | |
|---|---|---|---|---|
| 5,087,943 | A | 2/1992 | Creveling | |
| 5,708,940 | A * | 1/1998 | Hosaka et al. | 399/266 |
| 7,826,763 | B2 | 11/2010 | Doshohda et al. | |
| 2008/0038011 | A1 * | 2/2008 | Nakajima et al. | 399/100 |

FOREIGN PATENT DOCUMENTS

JP 42462/1990 2/1990

OTHER PUBLICATIONS

U.S. Appl. No. 13/030,220, filed Feb. 18, 2011, and entitled "Limited Ozone Generator Transfer Device" by Gerald F. Daloia, et al.
U.S. Appl. No. 13/160,836, filed Jun. 15, 2011, and entitled "Photoreceptor Charging and Erasing System" by Gerald F. Daloia, et al.
U.S. Appl. No. 13/160,845, filed Jun. 15, 2011, and entitled "Method for Externally Heating a Photoreceptor" by Gerald F. Daloia, et al.

* cited by examiner

*Primary Examiner* — David Gray
*Assistant Examiner* — Gregory H Curran

(57) ABSTRACT

An Active Ozone Scrubber includes a low profile thick film device. The low profile thick film device is composed of films layered upon each other and built on a ceramic substrate. Each layer is screened upon the next with the active elements strategically placed in order to develop corona when energized. When activated, the corona developed within the channels of the upper layer creates heat and accelerates the chemical reaction with the ozone, thereby reducing the amount of ozone generated by a conventional charge/discharge system before it is exhausted by a machine into the environment.

15 Claims, 3 Drawing Sheets

ACTIVE OZONE SCRUBBER

CROSS-REFERENCE TO RELATED APPLICATIONS

Cross-reference is hereby made to commonly assigned and co-pending U.S. application Ser. No. 13/030,220, filed Feb. 18, 2011, and entitled "Limited Ozone Generator Transfer Device" by Gerald F. Daloia, et al., now US Publication No. 20120213561, published Aug. 23, 2012, and co-pending U.S. application Ser. No. 13/160,836, filed Jun. 15, 2011, and entitled "Photoreceptor Charging and Erasing System" by Gerald F. Daloia, et al., and co-pending U.S. application Ser. No. 13/160,845, filed Jun. 15, 2011, and entitled "Method for Externally Heating a Photoreceptor" by Gerald F. Daloia, et al. The disclosures of the heretofore-mentioned applications are incorporated herein by reference in their entirety.

BACKGROUND

1. Field of the Disclosure

The present disclosure relates to an ozone removal device for removing ozone in an atmosphere, a method for removing ozone, and an image forming apparatus including the ozone removal device.

2. Description of Related Art

Typically, in an electrostatographic printing process of printers, a photoconductive or photoreceptor member is charged by a charging device to a substantially uniform potential so as to sensitize the surface thereof. The charged portion of the photoreceptor member is exposed to selectively dissipate the charges thereon in the irradiated areas. This records an electrostatic latent image on the photoreceptor member. After the electrostatic latent image is recorded on the photoreceptor member, the latent image is developed by bringing a developer material into contact therewith. Generally, the developer material comprises toner particles adhering triboelectrically to carrier granules. The toner particles are attracted from the carrier granules either to a donor roll or to a latent image on the photoreceptor member. The toner attracted to the donor roll is then deposited on latent electrostatic images on a charge retentive surface, which is usually a photoreceptor. The toner powder image is then transferred from the photoreceptor member to a copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

Electrostatographic printers of the heretofore-mentioned type may employ a number of fluid ionizing discharge devices. Conventional charge/discharge systems utilizing pin/wire scorotrons, corotrons or dicorotrons create ozone which is detrimental to other devices within the document generating system. For example, there may be one at the primary charge station for placing an initial charge of a film belt, and others at additional stations for precleaning the belt, transferring an image to a copy sheet from the belt and detacking the copy sheet from the belt. As is well known, each conventional charge/discharge device produces ions which interact with oxygen in the air to form ozone. As is also well known, ozone presents a serious health hazard to humans. Moreover, ozone can deteriorate machinery and can be especially destructive to photoreceptor elements, such as, film belts employed in electrostatographic machines. During the charging and discharging of a photoreceptor, the corona charging devices generate ozone which is typically measured to 2.0 PPM. Safe ozone levels are typically measured in the 0.1 PPM or less levels.

Attempts at addressing this problem have been made in the prior art in a number of ways. A typical ozone removing device includes either activated carbon or a metal oxide as ozone adsorption agents. Generally, these devices are passive and are placed in the vicinity of ozone producing components to remove any ozone which happens to drift into contact with the devices. In another approach, the ozone absorbing device is placed in proximity to a ventilation exit; however, with this approach, ozone can accumulate in dead air locations since ozone is only removed if entrained in an air ventilation stream. With each of these approaches, the ozone removing devices are relatively large, adding significantly to the size and cost of the device and machine. See, for example, U.S. Pat. No. 5,087,943. Japanese Unexamined Patent Publication No. 42462/1990 [Tokukaihei 2-42462 (published on Feb. 13, 1990)] discloses a technique for heat decomposition of Ozone with a heat source provided in an exhaust duct for exhausting ozone. However, employing a heat source requires raising the temperature to at least 100° C. That is, the temperature of the heat source needs to be raised between 120° C. and 150° C. in order to decompose approximately 50% of ozone while paper is being printed out of the machine. This electricity consumption creates a cost burden because a large amount of electricity is required.

An ozone removal device is shown in U.S. Pat. No. 7,826,763 B2 that combines the use of a honeycomb filter for gas treatment within a machine with an ion emitting unit for emitting negative ions into an atmosphere. A major portion of the ozone gas component is decomposed and absorbed by the filter with the residual ozone gas treatment component being decomposed by the negative ions being generated by the ion emitting unit.

Hence, even with the ozone removing devices disclosed heretofore, there is still a need for a cost effective method and apparatus that reduces the level of ambient ozone which has been emitted from conventional discharge devices.

BRIEF SUMMARY

In answer to this need, provided hereinafter is a method and apparatus that includes the use of a solid state charger as an ozone depletion device. The solid state charger puts out minimal ozone. And when put in the proximity of a conventional charge/discharge device(s) it effectively reduces the level of ambient ozone that is emitted from the conventional charge/discharge device(s).

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some such components are known per se' in other apparatus or applications, which may be additionally or alternatively used herein, including those from art cited herein. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
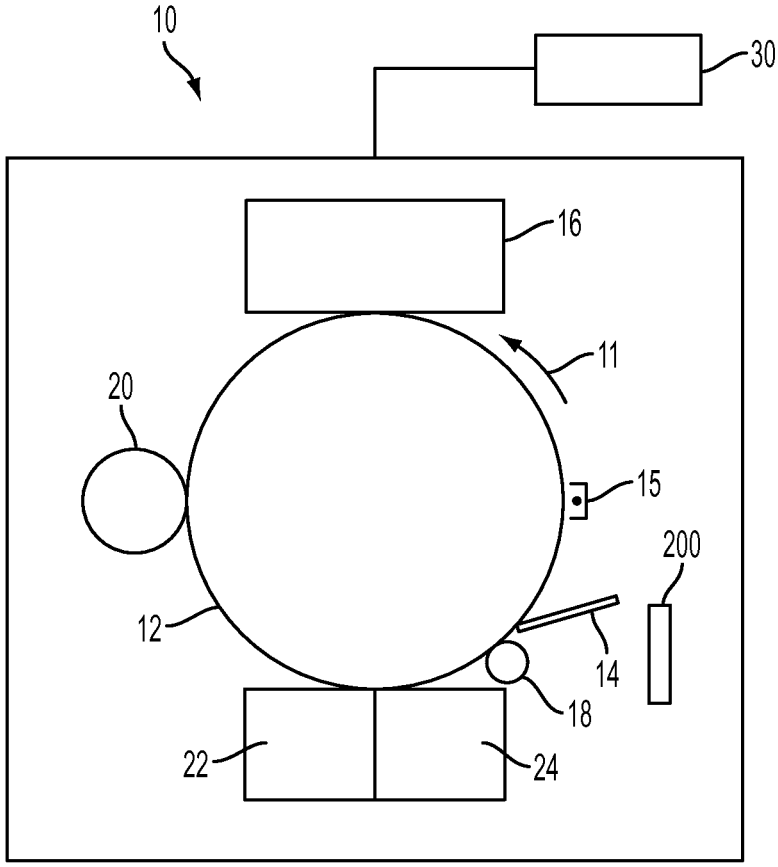
FIG. 1 is a partial, frontal view of an exemplary modular xerographic printer that includes the ozone depletion device of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method for removing ozone from the printing apparatus environment.

For a general understanding of the features of the disclosure, reference is made to the drawings. In the drawings, like reference numerals have been used throughout to identify identical elements.

Referring now to FIG. 1, an electrographic printing system is shown that includes the improved method for internally heating the atmosphere in the vicinity of conventional charge/discharge devices in order to control ozone emissions in accordance with the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose.

In FIG. 1, a marking device 10 is shown that includes a photoreceptor 12 that advances through processing stations in the direction of arrow 11, a charging device 15, an exposure device 16, a developer 20, a transfer device 22, a detack device 24, a pre-clean discharge device 18, a cleaning device 14, a solid state ozone depletion device 200, and a controller 30. Controller 30 controls a charge being applied to the photoreceptor 12 by charging device 15, then an image-wise pattern of light from exposure device 16 exposes and photodischarges the photoreceptor 12. Subsequently, charged toner particles are provided to adhere to the discharged areas of the photoreceptor 12, then the controller controls the application of a charge, with a sign opposite to the charge applied to the photoreceptor 12, to a receiving substrate at the transfer device 22 to remove the developed toner while retaining the image-wise pattern, and some additional charge is applied via the detack device 24 to the substrate to facilitate stripping of the substrate from the photoreceptor 12. Residual toner is then cleaned off the photoreceptor 12 by pre-clean discharge device 18 and cleaner 14.

Figure 2:
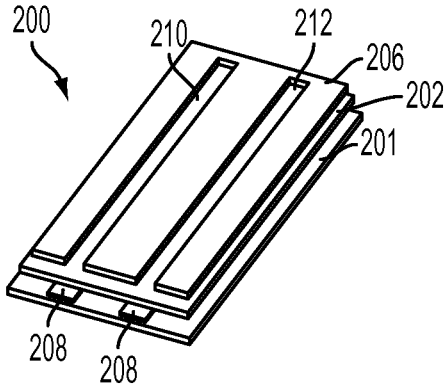
FIG. 2 is perspective view of the solid state ozone depletion device in accordance with the present disclosure used in the printing apparatus of FIG. 1.
Figure 3:
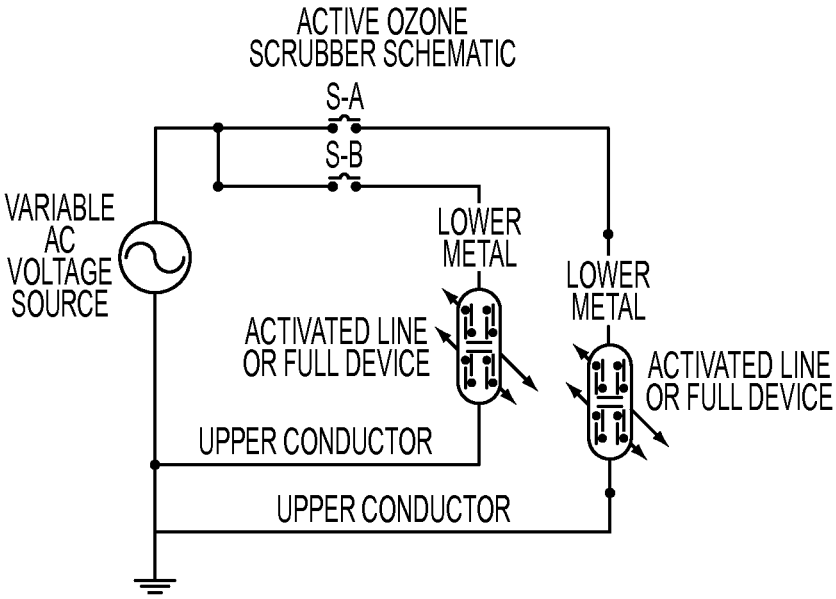
FIG. 3 is an Active Ozone Scrubber schematic for controlling ion production of the electrodes shown in FIG. 2.
Figure 4:
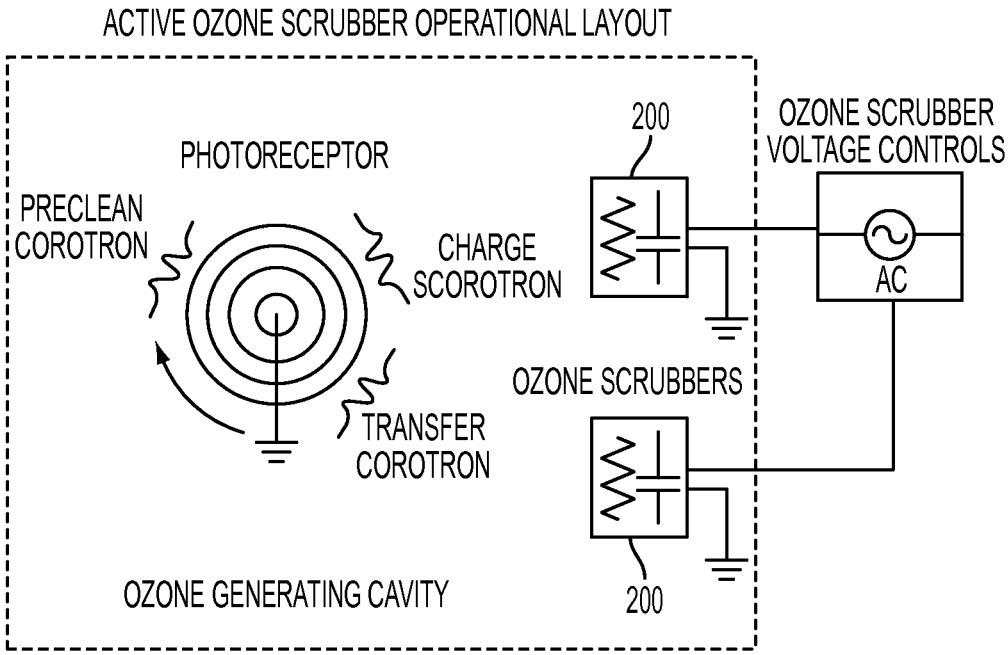
FIG. 4 is a solid state ozone depletion device operational depiction.

In accordance with the present disclosure, an Active Ozone Scrubber or solid state charging device 200 is put in the proximity of conventional charging devices in order to use the heat generated by the solid state charging device 200 to effectively reduce the level of ambient ozone which would be emitted from the conventional charging devices as shown in FIGS. 2-4. The Active Ozone Scrubber 200 is a low profile thick film mechanism of conductors and a dielectric over a ceramic base (FIG. 1). By applying a suitable AC voltage to the lower set of conductors of the device, a corona is produced in the channels of the upper conductor. Active Ozone Scrubber 200 in FIG. 2 is located in the vicinity of and in close proximity to, but not touching either of the conventional charging devices in order to heat the atmosphere around them. Active Ozone Scrubber 200 comprises a ceramic substrate 201 that supports a dielectric layer 202 positioned between two conductive layers 206 and 208. Conductive layer 206 includes slots 210 and 212 therein while conductor 208 is in the form of two conductive strips with the two conductive strips underlying the slots 210 and 212 of the upper electrode. Corona generation is created within the slots 210 and 212. When activated, the corona developed within the channels of the upper layer creates heat and thereby reducing the amount of ozone generated by a conventional charge/discharge system before it is exhausted by the machine into the environment.

The electrical schematic in FIG. 3 depicts Active Ozone Scrubber 200 in a two line operational mode. Each line has one electrode (lower conductor) and all electrodes have a common upper conductor (FIG. 2). Depending on the amount of ozone generated by the conventional charge/discharge devices determines the number of lower conductors to energize. Increasing the energized channels of lower conductors (i.e. channels which represent more surface area and thereby promote better ozone creation) increases the efficiency of the ozone scrubber. The Active Ozone Scrubber(s) must be placed in the ozone generating cavity, but not necessarily next to the ozone generating device. Control of the Active Ozone Scrubbers is done through the number of lower conductors activated and the amount of AC voltage applied to the lower conductors.

The scrubber device's selected materials allow for the thick film circuit to handle AC voltages as high as 3000 volts pk-pk. The ceramic's rigidity permits the device to be suspended in the vicinity of ozone producing devices 15, 18, 22 and 24, while being supported at its ends.

Switch S-A controls the AC high voltage delivered to the first upper electrode while switch S-B delivers the AC high voltage to the second upper electrode. Operation of the scrubber device requires the AC voltage to be greater than 1800 volts pk-pk in order to strike corona.

Corona generation and surface chemistry occurs when the upper electrodes are subjected to AC high voltage. The electrical fields that surround the electrodes cause the air molecules to ionize on the surface of the dielectric between the upper conductor fingers in slots 210 and 212 (FIG. 2).

In the Active Ozone Scrubber operational layout, such as, shown in FIG. 4, three conventional charge/discharge devices are shown positioned about a photoreceptor at a charging station, a preclean station and at an image transfer station within an ozone generating cavity. Two Active Ozone Scrubbers 200 are shown positioned within the ozone generating cavity and electrically connected to AC voltage controls for generating heat and thereby removing ozone from the ozone generating cavity before it exits the machine environment.

An advantage of the heretofore described method and apparatus for removing ozone from an ozone generating cavity before it reaches the atmosphere outside the machine environment includes providing a device that is restricted with respect to machine emissions, but simultaneously reducing requirements on ozone collection and filters, negative air, etc., in printers.

In recapitulation, an Active Ozone Scrubber is disclosed that comprises a low profile thick film device. The low profile thick film device is composed of films layered upon each other and built on a ceramic substrate. Each layer is screened upon the next with the active elements strategically placed in order to develop corona when energized. When activated, the corona developed within the channels of the upper layer creates heat and, thereby reducing the amount of ozone generated by a conventional charge/discharge system before it is exhausted by a machine into the environment.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for removing ozone from an ionization generating cavity in a xerographic device, comprising:

providing at least one ionization generating discharge device positioned within said ionization generating cavity;

providing an Active Ozone Scrubber separate and removed from said at least one ionization generating discharge device for heating an atmosphere within said ionization generating cavity in close proximity to said at least one ionization generating discharge device, and providing said Active Ozone Scrubber in a low profile configuration of upper and lower sets of conductors on opposite sides of a dielectric over a ceramic base, and wherein heat created by said Active Ozone Scrubber is accomplished solely through energizing said upper and lower sets of conductors of said Active Ozone Scrubber.

2. The method of claim 1, including providing multiple ionization generating discharge devices positioned around a charge receptive member within said ionization generating cavity.

3. The method of claim 2, including providing a photoreceptor as said charge receptor member.

4. The method of claim 2, including positioning multiple Active Ozone Scrubbers near said multiple ionization generating discharge devices.

5. The method of claim 1, including applying an AC voltage to said lower set of conductors of said Active Ozone Scrubber in order to produce corona in channels within said upper conductor.

6. The method of claim 5, including applying said AC voltage to said lower set of conductors to provide the heat to said ionization generating cavity.

7. The method of claim 5, including controlling said Active Ozone Scrubber through the number of lower conductors activated and the amount of AC voltage applied to said lower conductors.

8. The method of claim 1, including determining the number of lower conductors to provide and energize depending on the amount of ozone generated by said at least one ionization generating discharge device.

9. A printing apparatus, comprising:

a charge retentive member positioned within said housing;

at least one ionization generating device for charging said charge retentive member in image-wise configuration;

an imaging device for processing and recording images onto said charge retentive member;

an image development apparatus for developing said images;

a transfer device for transferring said images onto copy sheets;

a fuser for fusing said images onto said copy sheets; and a thick film solid state Active Ozone Scrubber that creates heat, and wherein said thick film solid state Active Ozone Scrubber comprises upper and lower conductors forming a sandwich with a dielectric substrate and positioned on a ceramic base, and wherein heat created by said Active Ozone Scrubber is accomplished solely through energizing said upper and lower conductors of said Active Ozone Scrubber.

10. The printing apparatus of claim 9, including an electrical circuit for applying an AC voltage to said lower conductors to produce corona within channels of said upper conductor.

11. The printing apparatus of claim 10, including multiple charge/discharge devices positioned around said charge retentive member.

12. The printing apparatus of claim 11, including multiple thick film solid state Active Ozone Scrubbers positioned to remove ozone emitted in the vicinity of said multiple charge/discharge devices.

13. An ozone depletion method for reducing ozone produced within a charge/discharge cavity of a printing apparatus, comprising:

providing a photoconductive substrate;

providing a plurality of charge and discharge devices around said photoconductive substrate;

providing an imaging apparatus for processing and recording images onto said photoconductive substrate;

developing said images on said photoconductive substrate;

transferring said developed images onto copy sheets;

fusing said images onto said copy sheets; and providing an Active Ozone Scrubber in a solid state configuration that includes upper and lower conductors and a dielectric over a ceramic, and wherein corona produced by applying an AC voltage to said upper and lower conductors is the sole source of heat from said Active Ozone Scrubber for reducing ozone created by said plurality of charge and discharge devices.

14. The ozone depletion method of claim 13, including a circuit for applying a predetermined amount of AC voltage to said lower set of conductors of said Active Ozone Scrubber to produce corona in the channels of said upper conductor.

15. The ozone depletion method of claim 14, wherein the amount of ozone generated by said plurality of charge and discharge devices determines the number of lower conductors to provide and energize.

* * * * *